United States Patent [19]

Akutsu et al.

[11] Patent Number: 4,740,420

[45] Date of Patent: Apr. 26, 1988

[54] RECORDING MEDIUM FOR INK-JET PRINTING

[75] Inventors: Eiichi Akutsu, Ichikawa; Tadashi Fujii, Yokohama; Kakuji Murakami, Shizuoka; Tamotsu Aruga, Numazu, all of Japan

[73] Assignee: Ricoh Company, Ltd., Tokyo, Japan

[21] Appl. No.: 875,528

[22] Filed: Jun. 20, 1986

Related U.S. Application Data

[63] Continuation of Ser. No. 646,060, Aug. 31, 1984, abandoned.

[30] Foreign Application Priority Data

Sep. 22, 1983 [JP] Japan ..... 58-174329

[51] Int. Cl.[4] ..... B41M 5/00

[52] U.S. Cl. ..... 428/341; 346/135.1; 427/261; 427/288; 428/195; 428/211; 428/342; 428/474.4; 428/479.6; 428/689; 428/696; 428/704; 428/914

[58] Field of Search ..... 346/1.1, 135.1; 400/126; 427/261, 288; 428/207, 211, 537.5, 195, 340–342, 474.4, 749.6, 689, 696, 704, 913, 914

[56] References Cited

U.S. PATENT DOCUMENTS

| | | | |
|---|---|---|---|
| 4,371,582 | 2/1983 | Sugiyama et al. | 428/341 |
| 4,381,185 | 4/1983 | Swanson et al. | 8/506 |
| 4,446,174 | 5/1984 | Maekawa et al. | 346/135.1 |

*Primary Examiner*—Bruce H. Hess

*Attorney, Agent, or Firm*—Oblon, Fisher, Spivak, McClelland & Maier

[57] ABSTRACT

A recording medium for ink-jet printing comprising a support material containing at least in the surface portion thereof a water-soluble metal salt with the ion valence of the metal thereof being 2 to 4 and a cationic organic material.

5 Claims, No Drawings

RECORDING MEDIUM FOR INK-JET PRINTING

This application is a continuation of application Ser. No. 646,060 filed Aug. 31, 1984, now abandoned.

BACKGROUND OF THE INVENTION

The present invention relates to a recording medium for ink-jet printing, and more particularly to a recording medium for ink-jet printing capable of yielding recorded images having high resistance to water.

As the coloring materials for conventional inks for ink-jet printing, highly water-soluble coloring materials are employed for attaining both stable ejection of the ink from the nozzles of an ink-jet printing apparatus, and high image density. Due to the use of highly water-soluble coloring materials, images recorded with conventional inks by the ink-jet printing disadvantageously easily spread and/or flow out when coming into contact with water.

In order to improve on the above problem, there have been proposed several methods. For example, in Japanese Laid-Open patent application No. 55-150396, there is proposed a method of treating the surface of a recording medium by coating a solution of a water-resistant treatment agent thereon after ink-jet printing in order to make the printed images resistant to water. When this method is employed, the ink-jet printing apparatus tends to become oversized and the coating of the water-resistant treatment agent causes the spreading of the printed images.

In another method disclosed in Japanese Laid-Open patent application No. 56-84992, the recording medium is treated with a poly cationic electrolyte before it is used. This method, however, has the shortcoming that the printed images are so vulnerable to light that the recording medium is not suitable for practical use.

In a further method disclosed in Japanese Laid-Open patent application No. 56-86789, the surface of a recording medium is treated with a 2- or more valence metal salt so as to fortify the printed images. This method, however, has the shortcoming that the color tone of the printed images is considerably changed by this treatment and is not suitable for full-color reproduction of images. Furthermore, this method has another shortcoming that the applied metal salts come off the surface of the recording medium, in the form of powder, thus, it is not suitable for practical use.

SUMMARY OF THE INVENTION

It is therefore an object of the present invention to provide a recording medium for ink-jet printing which is improved on the resistance to both water and light of the recorded images.

The object of the present invention is attained by treating the surface of a recording medium for ink-jet printing with a water-soluble metal salt, the valence of which metal is 2 to 4, and a cationic organic material, the combined use of which in particular serve to improve the resistance to water of the printed images.

DETAILED DESCRIPTION OF THE PREFERRED EMBODIMENTS

Examples of water-soluble metal salts for use in the present invention are salts with the cations thereof being 2-valence calcium cation, 2-valence zinc cation, 3-valence indium cation, 3-valence aluminum cation, 2-valence magnesium cation, and 4-valence tin cation.

Specific Examples of the salts are as follows:

Examples of 2-valence metal salts:

$MgCl_2$, $CaBr_2$, $CaCl_2$, $Ca(NO_3)_2$, $CaI_2$, $ZnCl_2$, $ZnBr_2$, $ZnI_2$, $Zn(ClO_3)_2$, $ZnSO_4$, $Zn(NO_3)_2$, $SrI_2$, $SrBr_2$, $SrCl_2$, $Sr(NO_3)_2$, $BaCl_2$, $Ba(NO_3)_2$, $Ba(OH)_2$, $BaI_2$, $BaBr_2$, $Fe(NO_3)_2$, $Ni(NO_3)_2$, $NiSO_4$, $NiCl_2$, $CuCl_2$, $CuSO_4$.

Examples of 3-valence metal salts:

$AlCl_3$, $Al_2(SO_4)_3$, $Al(NO_3)_3$, $ScCl_3$, $Sc(NO_3)_3$, $Sc_2(SO_4)_3$, $Ga(NO_3)_3$, $GaCl_3$, $Ga_2(SO_4)_3$, $InCl_3$, $Fe(NO_3)_3$ and alums.

Examples of 4-valence metal salts:

$TiCl_4$, $GeCl_4$, $Zr(SO_4)_2$, $SnCl_4$, $Sn(SO_4)_2$, $Pb(CH_3COO)_2$.

Of the above water-soluble metal salts, $AlCl_3$, $Al_2(SO_4)_3$, $Al(NO_3)_2$, $ZnCl_2$, $ZnSO_4$, $SnCl_4$, $CaCl_2$, $MgCl_2$ and $InCl_3$ are particularly preferable for use in the recording medium according to the present invention.

The above water-soluble metal salts can be used alone or in combination and are excellent for attaining the whiteness, non-pollution, non-changing of the color tone, high resistance to light (i.e., non-fading when exposed to light) and high resistance to water of the images recorded on the recording medium according to the present invention.

The content of these water-soluble metal salts in the recording medium is preferably in the range of 0.1 $g/m^2$ to 10 $g/m^2$, more preferably in the range of 0.4 $g/m^2$ to 3.0 $g/m^2$. When the content of the water-soluble metal salts is less than 0.1 $g/m^2$, the water-resistance and light-resistance of the printed images decrease, while when the content is more than 10 $g/m^2$, the water-soluble metal salts come off the recording surface of the recording medium in the form of powder or the recording surface becomes sticky, so that when a pen using an aqueous ink is employed, the tip of the pen is easily plugged with the metal salts and other materials in the recording surface.

As the cationic organic materials, salts of alkylamines, quaternary ammonium salts, polyamines and basic latexes can be employed.

Specific examples of the salts of alkylamines are as follows:

decylammonium acetate, undecylammonium acetate, dodecylammonium acetate, tridecylammonium acetate, tetradecylammonium acetate, pentadecylammonium acetate, hexadecylammonium acetate, heptadecylammonium acetate, octadecylammonium acetate, nonadecylammonium acetate, eicosylammonium acetate, decylammonium chloride, undecylammonium chloride, dodecylammonium chloride, tridecylammonium chloride, tetradecylammonium chloride, pentadecylammonium chloride, hexadecylammonium chloride, heptadecylammonium chloride, octadecylammonium chloride, nonadecylammonium chloride and eicosylammonium chloride.

When such salts of alkylamines are employed, the content of the alkylamine salts in the recording medium is preferably in the range of 0.05 $g/m^2$ to 8 $g/m^2$, more preferably in the range of 0.2 $g/m^2$ to 5 $g/m^2$. When the content of such salts of alkylamines is less than 0.05 $g/m^2$, the water-resistance of the printed images is insufficient for practical use, while when the content is more than 8 $g/m^2$, the light-resistance of the printed images decreases and the recording surface absorbs water and becomes sticky, so that when a pen using an aqueous ink is employed, the tip of the pen is easily plugged with the salts of alkylamines and other materials in the recording surface.

Specific examples of the quaternary ammonium salts are as follows:

lauryltrimethylammonium bromide, lauryltrimethylammonium chloride, cetyltrimethylammonium bromide, cetyltrimethylammonium chloride, octaisoquinolinium bromide, octaisoquinolinium chloride, hexadecyltrimethylammonium bromide, and hexadecyltrimethylammonium chloride.

When such quaternary ammonium salts are employed, the content of the quaternary ammonium salts in the recording medium is preferably in the range of 0.05 $g/m^2$ to 8 $g/m^2$, more preferably in the range of 0.2 $g/m^2$ to 5 $g/m^2$. When the content of the quaternary ammonium salts is less than 0.05 $g/m^2$, the water-resistance of the printed images is insufficient for practical use, while when the content is more than 8 $g/m^2$, the light-resistance of the printed images decreases and the recording surface absorbs water and becomes sticky, so that when a pen using an aqueous ink is employed, the tip of the pen is plugged with the quaternary ammonium salts and other materials in the recording surface.

Specific examples of polyamines are as follows:

polyamide polyamine, polyoxyethylene alkylamine, polyethyamine epichlorohydrin, polydimethylaminoethyl methacrylate, and polyalkylammonium.

Furthermore, basic latexes, such as polyamine latex and alkylammonium latex, can be employed. When these basic latexes are used in the recording medium, the content of the latexes is preferably in the range of 0.2 $g/m^2$ to 25 $g/m^2$, more preferably in the range of 0.4 $g/m^2$ to 10 $g/m^2$. When the content of the such basic latexes is less than 0.05 $g/m^2$, the water-resistance of the printed images is insufficient for practical use, while when the content is more than 8 $g/m^2$, the light-resistance of the printed images decreases and the recording surface absorbs water and becomes sticky, so that when a pen using an aqueous ink is employed, the tip of the pen is easily plugged with the such basic latexes and other materials in the recording surface.

As commercially available cationic organic material, there are known San Fix 555 (Sanyo Chemical Industries, Ltd.), polyamine condensates, Morin Fix 3p (made by Morimoto Chemicals Co., Ltd.) and Fix FM (Made by Kuroda Kagaku Kogyo Co., Ltd.), although the chemical components and structures of these materials are not known to customers.

A recording medium of a single layer type according to the present invention can be prepared by immersing a support material made of, for example, plain paper, non-sized paper or a plastic film capable of absorbing water, in a solution or dispersion of a mixture of one of the above water-soluble metal salts and one of the cationic organic materials, which mixture, as mentioned previously, serves to improve the resistance to water of the printed images and is hereinafter referred to as water-resistance improving agent.

A recording medium of a multi-layered type according to the present invention can be prepared by coating a surface layer on a support material. The surface layer consists essentially of a binder agent, a pigment, the water-resistance improving agent and a small amount of additives. In the case of the multi-layered type recording medium, it is not always necessary that the support material is capable of absorbing water. It can be made of a non-water-absorbing material, such as paper consisting essentially of cellulose, synthetic paper, plastic film, glass, metal plate and metal foil.

As the binder agents for use in the above-mentioned surface layer, the following can be employed, which are classified into two groups, resin-type binder agents and latex-type binder agents:

A. Resin-type binder agents:

Oxidized starch, etherified starch, esterified starch, dextrin, casein, gelatin, arabic gum, vegetable protein, cellulose, carboxymethylcellulose, hydroxyethylcellulose, cellulose derivatives, polyvinyl alcohol, polyvinylpyrrolidone, maleic anhydride resin, polyvinyl acetate, polyvinyl butyral, polyacrylamide, combinations of the above polymers, copolymers of the above polymers, and modified polymers of the above polymers.

B. Latex-type binder agents:

Polyvinyl acetate latex, styrene-isoprene copolymer latex, styrene-butadiene copolymer latex, acrylic polymer latex, acrylic derivative - vinyl acetate copolymer latex, methyl methacrylate - butadiene copolymer latex, and combinations and modifications of the above latexes.

Specific examples of the pigments for use in the surface layer are as follows:

clay, talc, diatomaceous earth, calcium carbonate, calcium sulfate, magnesium carbonate, magnesium sulfate, barium sulfate, titaniumum oxide, zinc oxide, zinc sulfide, zinc carbonate, titanium white, aluminum silicate, silicon oxide, calcium silicate, aluminum oxide, aluminum hydroxide, zeolite.

Of the above-mentioned pigments, calcium carbonate, magnesium carbonate, barium sulfate and titanium white are most preferable for use in the layer.

The multi-layered type recording medium according to the present invention can be prepared by coating on a support material a dispersion consisting essentially of one of the above-mentioned pigments and one of the above-mentioned binder agents by a blade coating method, an air-knife coating method, a bead coating method, a roll coating method, a wire bar coating method, a spray coating method, a gravure coating method or a reverse roller coating method, and the coated dispersion is dried by application of hot air or heat thereto, with a coating deposition ranging from 0.1 $g/m^2$ to 60 $g/m^2$, more preferably ranging from 3 $g/m^2$ to 20 $g/m^2$, whereby a first layer is formed on the support material. To the first layer, a liquid containing the water-resistance improving agent in an amount ranging from 0.1 wt. % to 30 wt. % is applied by one of the above-mentioned coating methods and is then dried, whereby a recording medium for use in the present invention is prepared.

The recording medium which is prepared by the just mentioned method or by impregnating the support material with previously mentioned water-resistance improving agent is then subjected to calendering at temperatures ranging from 50° C. to 200° C., more preferably ranging from 60° C. to 120° C., with application of pressure ranging from 10 kg/cm to 150 kg/cm, more preferably ranging from 50 kg/cm to 80 kg/cm, whereby the recording performance of the recording medium can be improved.

Embodiments of a recording medium for ink-jet printing will now be explained in detail by referring to the following examples:

Example 1

A mixture of the following components was dispersed in a ball mill for 12 hours, whereby a dispersion was prepared.

| | Parts by Weight |
|---|---|
| Calcium carbonate powder | 45 |
| Silica powder | 25 |
| Casein | 3 |
| Methylmethacrylate-butadiene copolymer latex (solid components) | 25 |
| Water | 60 |
| San Fix 555 (Sanyo Chemical Industries, Ltd.) | 3 |

The thus prepared dispersion was applied to a sheet of high quality paper having a thickness of 95 μm by a doctor blade with a solid-component deposition of 15 g/m$^2$, and was then dried at 120° C. for 5 minutes, whereby a first layer for a recording surface layer was formed on the paper.

To this first layer, there was applied a 2 wt. % aqueous solution of aluminum chloride by an air-knife coating method with a wet coating amount of 35 g/m$^2$ and the applied solution was then dried at 110° C. for 8 minutes, so that a recording medium was prepared. This recording medium was then subjected to calendering at 80° C. with application of a pressure of 65 kg/cm, whereby an ink-jet recording medium No. 1 according to the present invention was prepared.

Ink-jet printing was then performed on the thus prepared recording medium No. 1 by a commercially available ink-jet printer (JP-4100 Printer made by Ricoh Company, Ltd.), using an ink prepared by the following formulation:

| | Parts by Weight |
|---|---|
| C.I. Acid Red 92 (Daiwa Dyestuff Mfg. Co., Ltd.) | 4 |
| Diethylene Glycol | 15 |
| Glycerin | 5 |
| Deltop 33 (Takeda Chemical Industries, Ltd.) | 0.5 |
| Water | 75.5 |

The thus prepared recording medium No. 1 according to the present invention and the images printed thereon were subjected to the following evaluation tests:

1. Surface Smoothness Test by Bekk Tester (Japanese Industrial Standards), by which the surface smoothness of the recording medium was measured.

2. Brightness Test by Hunter (Japanese Industrial Standards), by which the whiteness of the recording medium was measured.

3. GATF Color Evaluation Test with respect to Hue Error and Greyness, by which the hue error and the greyness of the printed images were evaluated.

4. Surface Hardness Test by Scratching of the Surface with Pencils (Japanese Industrial Standards), by which the strength of the recording surface layer of the recording medium was checked.

5. Printed Image Dryness Test

On the recording medium, ink-jet printing was performed by the above-mentioned ink-jet printing apparatus. After printing, the recording medium was brought into pressure contact with a filter paper with the intervals of 1 second, and the time at which no ink was transferred from the recording medium to the filter paper was checked, whereby the dryness of the printed images was evaluated.

6. Water Resistance Test of Printed Images

After printing on the recording medium, the recording medium was immersed in water at a temperature of 30° C. for 1 minute. Thereafter, the change in image density by the immersion was determined by comparing the image density before the immersion and the image density after the immersion. The change in image density was regarded as the image density fading ratio from which the water resistance of the printed images was assessed.

7. Light Resistance of Printed Images

The printed images were exposed to the light of a carbon arc lamp for 8 hours. The fading ratio of the reflected image density of the images was calculated in accordance with the following formula:

$$\frac{\text{Change in Image Density}}{\text{Initial Image Density}} \times 100$$

The results of the above tests are shown in Table 1.

COMPARATIVE EXAMPLE 1

Example 1 was repeated except that the step of coating 2 wt. % aqueous solution aluminum chloride in Example 1 was eliminated, whereby a comparative recording medium No. 1 for ink-jet printing was prepared. The thus prepared comparative recording medium No. 1 was subjected to the same evaluation tests as in Example 1. The results are shown in Table 1.

EXAMPLE 2

A mixture of the following components was dispersed in a homogenizer for 12 hours, whereby a dispersion for forming a first layer was prepared.

| | Parts by Weight |
|---|---|
| Silica powder | 25 |
| Calcium carbonate powder | 45 |
| Styrene-butadiene copolymer latex (solid components) | 30 |
| Polyvinyl alcohol (Kuraray 205) | 5 |
| Casein | 3 |
| Cetyltrimethylammonium chloride | 1 |
| Polyamine condensate (Morin Fix 3p made by Morimoto Chemicals, Inc.) | 1 |
| Water | 70 |

The thus prepared dispersion was coated on a sheet of medium quality paper having a thickness of 85 μm by a metal bar with a solid-component deposition of 10 g/m$^2$, and was then dried at 115° C. for 12 minutes, whereby a first layer for a recording layer was formed on the paper.

To this first layer, there was applied a 5 wt. % aqueous solution of aluminum nitrate by a bead coating method with a wet coating amount of 18 g/m$^2$ and the applied solution was dried at 115° C. for 10 minutes and then subjected to heating and pressure-application calendering at 85° C. with application of a pressure of 70 kg/cm, whereby a recording medium No. 2 according to the present invention was prepared.

The thus prepared recording medium No. 2 according to the present invention was subjected to the same evaluation tests as in Example 1. The results are shown in Table 1.

COMPARATIVE EXAMPLE 2

Example 2 was repeated except that the cetyltrimethylammonium chloride and the polyamine condensate were eliminated from the formulation of the first layer formation liquid and the wet coating amount of the 5 wt. % aqueous solution of aluminum nitrate was changed from 18 g/m$^2$ to 30 g/m$^2$, whereby a comparative recording medium No. 2 was prepared.

The thus prepared comparative recording medium No. 2 was subjected to the same evaluation tests as in Example 1. The results are shown in Table 1.

EXAMPLE 3

A solution of the following components was prepared:

| | Parts by Weight |
|---|---|
| Polyamine condensate (Fix FM made by Kuroda Kagaku Kogyo, Company, Ltd.) | 5 |
| Tin chloride | 2 |
| Water | 93 |

The above solution was coated on a commercially available recording paper for ink-jet printing (R-17 paper having a sizing degree of 3 sec) by air-knife coating with a wet coating amount of 25 g/m$^2$. The coated solution was then dried at 105° C. for 12 minutes, whereby a recording medium No. 3 according to the present invention was prepared.

The thus prepared recording medium No. 3 according to the present invention was subjected to the same evaluation tests as in Example 1. The results are shown in Table 1.

EXAMPLE 4

A mixture of a 5 wt. % solution of $AlCl_3$ and a 0.2 wt. % solution of decylammonium acetate was coated on a commercially available recording paper for ink-jet printing (M8 coated paper made by Mitsubishi Paper Mills, Ltd.) by a bead coating method with a wet coating amount of 40 g/m$^2$. The coated solution was then dried at 105° C. for 10 minutes, whereby a recording medium No. 4 according to the present invention was prepared.

The thus prepared recorded medium No.4 according to the present invention was subjected to the same evaluation tests as in Example 1. The results are shown in Table 1.

TABLE 1

| | Ex. 1 | C. Ex. 1 | Ex. 2 | C. Ex. 2 | Ex. 3 | Ex. 4 |
|---|---|---|---|---|---|---|
| Smoothness | 220 | 210 | 640 | 610 | 80 | 190 |
| Whiteness | 82 | 82 | 84 | 84 | 81 | 82 |
| Hue Error | 40 | 39 | 42 | 45 | 48 | 42 |
| Surface Hardness | H | H | HB | HB | — | H |
| Dryness (seconds) | 1 | 1 | 1 | 1 | 1 | 2 |
| Water- | 4% | 6% | 2% | 15% | 5% | 2% |
| Light-resistance | 7% | 42% | 6% | 7% | 9% | 9% |

As can be seen from the above results, the recording mediums according to the present invention are improved in the water-resistance and light resistance of the printed images without degrading the other properties as compared with the comparative recording mediums.

What is claimed is:

1. A recording medium for ink-jet printing consisting essentially of a preformed support material upon which there has been deposited a pigment free mixture consisting essentially of a water-soluble metal salt with the ion valence of the metal thereof being 2 to 4 and a cationic organic material, wherein the content of said water-soluble metal salt on the preformed support material is in the range of 0.4 g/m$^2$ to 3.0 g/m$^2$, wherein said cationic organic material is selected from the group consisting of salts of alkylamines, quaternary ammonium salts and polyamines, wherein the content of said selected salt of alkylamines on the preformed support material is in the range of 0.2 g/m$^2$ to 5.0 g/m$^2$, wherein the content of said selected quaternary ammonium salt on the preformed support material is in the range of 0.2 g/m$^2$ to 5.0 g/m$^2$, wherein the content of said selected polyamines on the preformed support material is in the range of 0.2 g/m$^2$ to 5.0 g/m$^2$.

2. A recording medium for ink-jet printing as claimed in claim 1, wherein said water-soluble metal salt is selected from the group consisting of salts with the cations thereof being 2-valence calcium cation, 2-valence zinc cation, 3-valence indium cation, 3-valence aluminum cation, 2-valence magnesium cation and 4-valence tin cation.

3. A recording medium for ink-jet printing consisting essentially of a preformed support material upon which there has been deposited a pigment free mixture consisting essentially of a water-soluble metal salt with the ion valvence of the metal thereof being 2 to 4 and a cationic organic material, wherein the content of said water-soluble metal salt on the preformed support materail is in the range of 0.4 g/m$^2$ to 3.0 g/m$^2$, wherein said cationic organic material is a salt of alkylamine selected from the group consisting of decylammonium acetate, undecylammonium acetate, dodecylammonium acetate, tridecylammonium acetate, tetradecylammonium acetate, pentadecylammonium acetate, hexadecylammonium acetate, heptadecylammonium acetate, octadecylammonium acetate, nonadecylammonium acetate, eicodesylammonium acetate, decylammonium chloride, undecylammonium chloride, dodecylammonium chloride, tridecylammonium chloride, tetradecylammonium chloride, pentadecylammonium chloride, hexadecylammonium chloride, heptadecylammonium chloride, octadecylammonium chloride, nonadecylammonium chloride and eicosylammonium chloride, wherein the content of said salt of alkylamines on the performed support material is in the range of 0.2 g/m$^2$ to 5.0 g/m$^2$.

4. A recording medium for ink-jet printing, consisting essentially of a preformed support material upon which there has been deposited a pigment free mixture consisting essentially of a water-soluble metal salt with the ion valence of the metal thereof being 2 to 4 and a cationic organic material, wherein the content of said water-soluble metal salt on the preformed support material is in the range of 0.4 g/m$^2$ to 3.0 g/m$^2$, wherein said cationic organic material is a quaternary ammonium salt selected from the group consisting of laurylthrmethylamonium bromide, lauryltrimethylammonium chloride, cetyltrimethylammonium bromide, cetyltrimethylammonium chloride, octaisoquinolinuium bromide, octaisoquinolinium chloride, hexadecyltrimethylammonium bromide, and hexadecyltrimethylammonium chloride, wherein the content of said selected quanternary ammonium salt on the preformed support material is in the range of 0.2 g/m$^2$ to 5.0 g/m$^2$.

5. A recording medium for ink-jet printing consisting essentialy of a preformed support material upon which there has been deposited a pigment free mixture consisting essentially of a water-soluble metal salt with the ion valence of the metal thereof being 2 to 4 and a cationic organic material, wherein the content of said water-soluble metal salt on the preformed support material is in the range of 0.4 g/m$^2$ to 3.0 g/m$^2$, wherein said cationic organic material is a polyamine selected from the group consisting of polyamide polyamine, polyoxyethylene alkylamine, polyethyamine epichlorohydrin, polydimethylaminoethyl methacrylate, and polyalkylammonium, and wherein the content of said polyamine on the preformed support material is in the range of 0.2 g/m$^2$ to 5.0 g/m$^2$.

* * * * *